United States Patent [19]

Ostrowski et al.

[11] 4,073,128

[45] Feb. 14, 1978

[54] METHOD AND APPARATUS FOR MANUFACTURING OF YARN

[75] Inventors: Jerzy Ostrowski; Piotr Sierputowski, both of Warsaw; Lukasz Turkowski, Sule Jowek-Ratajewo; Jerzy Jablkiewicz; Jan Pacholski, both of Lodz; Tadeusz Jedryka, Warsaw, all of Poland

[73] Assignee: Centralny Osrodek Badawczo-Rozwojowy Maszyn Wlokienniczych, Lodz, Poland

[21] Appl. No.: 774,113

[22] Filed: Mar. 3, 1977

[30] Foreign Application Priority Data

Mar. 10, 1976 Poland ..... 187856

[51] Int. Cl.[2] ..... D01H 1/12

[52] U.S. Cl. ..... 57/58.89; 57/160

[58] Field of Search ..... 57/58.89–58.95, 57/5, 34 R, 156, 160

[56] References Cited

U.S. PATENT DOCUMENTS

| | | | |
|---|---|---|---|
| 3,577,720 | 5/1971 | Zax et al. | 57/58.89 |
| 3,851,455 | 12/1974 | Jozwicki et al. | 57/58.95 |
| 3,898,787 | 8/1975 | Wehling et al. | 57/58.89 |
| 3,994,120 | 11/1976 | Radom et al. | 57/58.89 |

FOREIGN PATENT DOCUMENTS

| | | | |
|---|---|---|---|
| 244,159 | 9/1969 | U.S.S.R. | 57/58.89 |
| 244,160 | 9/1969 | U.S.S.R. | 57/58.89 |

*Primary Examiner*—Donald Watkins
*Attorney, Agent, or Firm*—Haseltine, Lake & Waters

[57] ABSTRACT

The method and apparatus for manufacture of yarn from natural- and synthetic fibres, using a pneumatic spinning technique. The method according to the present invention is directed to fibres entrained in an air jet stream introduced into the non-rotational spinning chamber containing the fibres. The air jets having been whirled into the chamber by a system of nozzles and some portion of the air jet, in which the fibers are entrained, becomes separated inside the chamber and directed to the whirl cone zone to reduce the flow rate within this whirl core. The apparatus for carrying out the method of the invention consists of a cylindrical, non-rotational spinning chamber having a cylindrical insert disposed therein at one end and peripheral air supply ducts, as well as fiber delivery channel at the other end. The insert at the side of a yarn discharge channel inlet, incorporates the peripheral ports provided with inlet means located between the channel and the ducts.

2 Claims, 2 Drawing Figures

METHOD AND APPARATUS FOR MANUFACTURING OF YARN

BACKGROUND OF THE INVENTION

This invention is directed to a method and apparatus for manufacturing of yarn from natural- and synthetic fibres, using a pneumatic spinning technique.

Prior art equipment and methods for pneumatic manufacturing of yarn with fibres having been entrained by air introduced into a non-rotational spinning chamber, form a ring caused by the air jets to whirling over the chamber inner walls, within a plane perpendicular to the chamber center line. Accordingly, the yarn becomes formed and twisted by gathering of fibres from the whirling ring, and finally discharged out of the chamber.

At the vacuum source side, the chamber is provided with the peripheral tangent ducts to supply air, and a fibre delivery channel, the latter being located in the chamber upper part, above the outlet of the yarn discharge channel.

In operation, the spinning rate is proportional to the peripheral velocities in the zone where the fibre ring is being formed, in the spinning section. The field of the peripheral velocities as it is being formed is counteracted by the whirl core being generated in the chamber center line, where rotational field intensification takes place. The powerful whirl core adversely affects the velocity field distribution, thus preventing the formation of a velocity distribution that is correct, since a distinct maximum occurs at the chamber walls. With such a powerful whirl core, the peripheral velocity field distributions display the velocity maximum shifted towards the chamber center, in direction of smaller radii. Such being the case, the formation of the peripheral velocities at the chamber walls appears impracticable.

SUMMARY OF THE INVENTION

The principal features of the invention are directed to reducing the air flow rate in the whirl core by separation of the fibre delivering air jet portion, and its disposal to the whirl core zone, thus causing that the rotational velocity within the whirl core to becomes inhibited. The intensively swirling air flows into this whirl core.

Also within the scope of the invention is a cylindrical spinning chamber provided with a cylindrical insert having, from the yarn discharge side, peripheral ports diagonal to the chamber center line. These ports guide some selected portions of air into the whirl core and have an inlet located between a fibre delivery channel and air supply ducts.

The main object of the invention is to overcome the defects of the prior art.

Another object of the invention is to reduce the rotational flow rate within the whirl core zone to distribute the velocity in the section where the yarn is being formed from the ring of rotating fibres, to spin at higher rates.

Other objects of the present invention may be more readily understood with respect to the accompanying specification, claims and drawings.

IN THE DRAWINGS

PREFERRED EMBODIMENT

Figure 1:
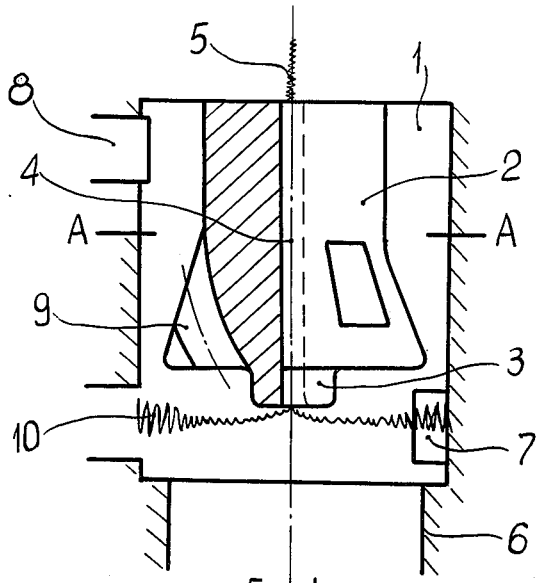
FIG. 1 illustrates an axial cross-section of the present invention.
Figure 2:
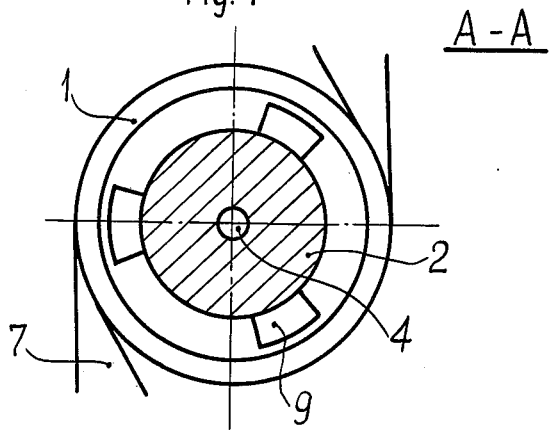
FIG. 2 illustrates the invention as shown in FIG. 1 in cross-sectional view taken along line A—A.

FIG. 1 shows a non-rotational spinning chamber 1 having at one end, a cylindrical insert 2, the latter being widened in conical form and ended with the cylindrical boss 3. The cylindrical insert 2 incorporates a concentric channel 4 to discharge the ready yarn 5, its inlet being situated in the said boss 3. From the other end, the chamber 1 communicates, via the suction duct 6 having a source of vacuum (not shown). From that vacuum source side, the chamber 1 has peripheral tangent ducts 7 to supply air. Above the channel 4 inlet, a fibre delivery channel 8 outlet is formed in the chamber wall. From the yarn discharge side, ports 9 are provided on insert 2 conical part periphery diagonal to the chamber 1 center line. Their inlet is located between the fibre delivery channel 8 and the air supply ducts 7.

The principle of the invention employs an arrangement of the passages 7 and 8, so that air drawn into the chamber 1 will be forced to whirl therein. The fibres, having been entrained by the air jet and introduced into the chamber interior, are caused to rotate under the influence of the whirling air jet, thus forming the fibre ring 10, which rotates in a plane perpendicular to the chamber center line. The fibre deliverying air jet is divided inside the chamber 1, a portion of it passing through the ports 9, and the other part over the chamber walls. The air stream flowing through the ports 9 change their velocity direction; the circumferential velocity components becoming reduced, with the axial ones rising at a time. Thus, the introduced air jets cause reduction of the whirl core kinetic energy, according to the delivered air volume and the axial component values. They also reduce the angular momentum transport to the whirl core.

To start spinning, through the concentric channel 4, a length of yarn is introduced into the chamber interior. When caused to rotate by the produced air vortex, this length of yarn will gather the fibres from the whirling ring 10, and become twisted. The ready yarn 5 is discharged through the channel 4 to the chamber 1 outside.

While we have illustrated a preferred embodiment of the present invention, many modifications may be made without departing from the spirit of the invention. We do not wish to be limited by the precise details of construction set forth but desire to avail ourselves of all changes within the scope of the appended claims.

We claim:

1. A method of manufacturing yarn, where fibres that have been entrained in an air stream are introduced into a nonrotational chamber, and providing said fibers with rotational motion by an air flow whirled into the chamber through a nozzle system, including the steps of: urging some portion of said air stream acting on said fibres to separate within the chamber; and directing said separated air stream to a whirl core zone for reducing the air flow rate within said core.

2. An apparatus for manufacturing yarn, employing a cylindrical, non-rotational spinning chamber having a source of vacuum at one end; the other end of said chamber being closed with a cylindrical insert incorporating a concentric channel to discharge ready yarn; duct means for supplying air to said chamber interior; fibre delivery channel means disposed within said chamber including: cylindrical insert means disposed at a yarn discharge side, said insert having peripheral ports diagonally arranged in relation to a centre line of said chamber, and port inlet means disposed between said discharge channel and said duct means.

* * * * *